United States Patent [19]

Halopoff

[11] 4,082,133

[45] Apr. 4, 1978

[54] SECTIONAL GARAGE DOOR SPRING CONTAINER

[76] Inventor: William Halopoff, 17720 Crusader St., Cerritos, Calif. 90701

[21] Appl. No.: 785,561

[22] Filed: Apr. 7, 1977

Related U.S. Application Data

[63] Continuation-in-part of Ser. No. 692,340, Jun. 3, 1976, abandoned.

[51] Int. Cl.[2] ..... E05F 11/00

[52] U.S. Cl. ..... 160/191; 49/197

[58] Field of Search ..... 160/189, 191, 192; 49/199, 200, 197; 16/193, 197; 267/69, 73, 74

[56] References Cited

U.S. PATENT DOCUMENTS

| | | | |
|---|---|---|---|
| 1,826,647 | 10/1931 | Blodgett | 160/191 |
| 1,983,856 | 12/1934 | Johnson | 160/191 |
| 2,171,194 | 8/1939 | Smith | 160/191 |
| 3,146,825 | 9/1964 | Briggs, Jr. et al. | 160/191 |
| 3,272,496 | 9/1966 | Halopoff | 267/74 |
| 3,958,367 | 5/1967 | Fairman | 267/74 |

*Primary Examiner*—Peter M. Caun

[57] ABSTRACT

A counterbalance spring for garage doors of the sectional type which slide upward and over a horizontal track is located above and parallel to the track. The spring is a coiled spring which, after a period of time may fracture under tension and broken parts consequently may be thrown about at some peril. To contain the broken parts a rod extends through the coiled spring, is fastened to the building structure at both ends, and the pulley connected to one end of the spring is mounted on a carrier which slides on and is guided by the rod. The initial impact resulting from fracture of the spring while under tension is absorbed by a deformation of the rod serving as a cushion.

5 Claims, 9 Drawing Figures

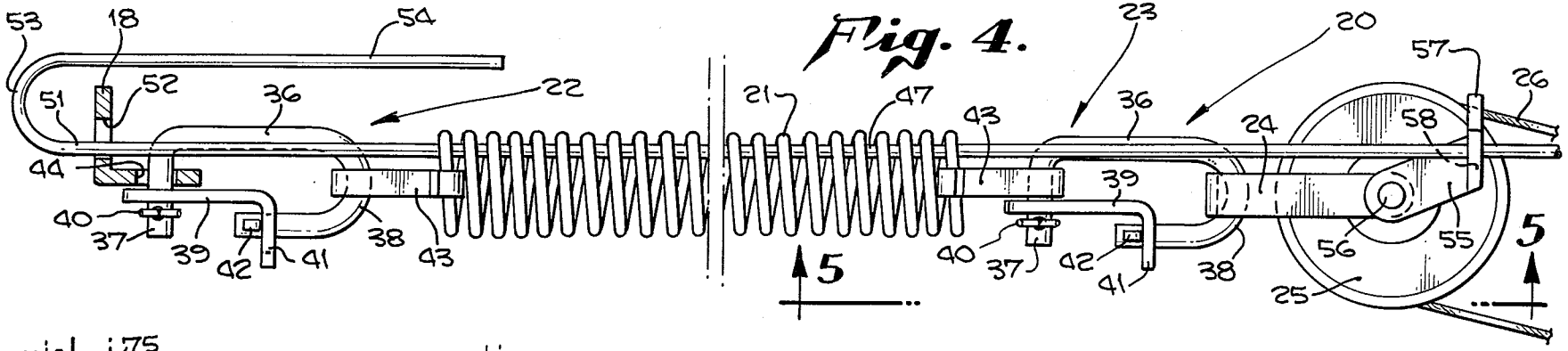
Fig. 4.
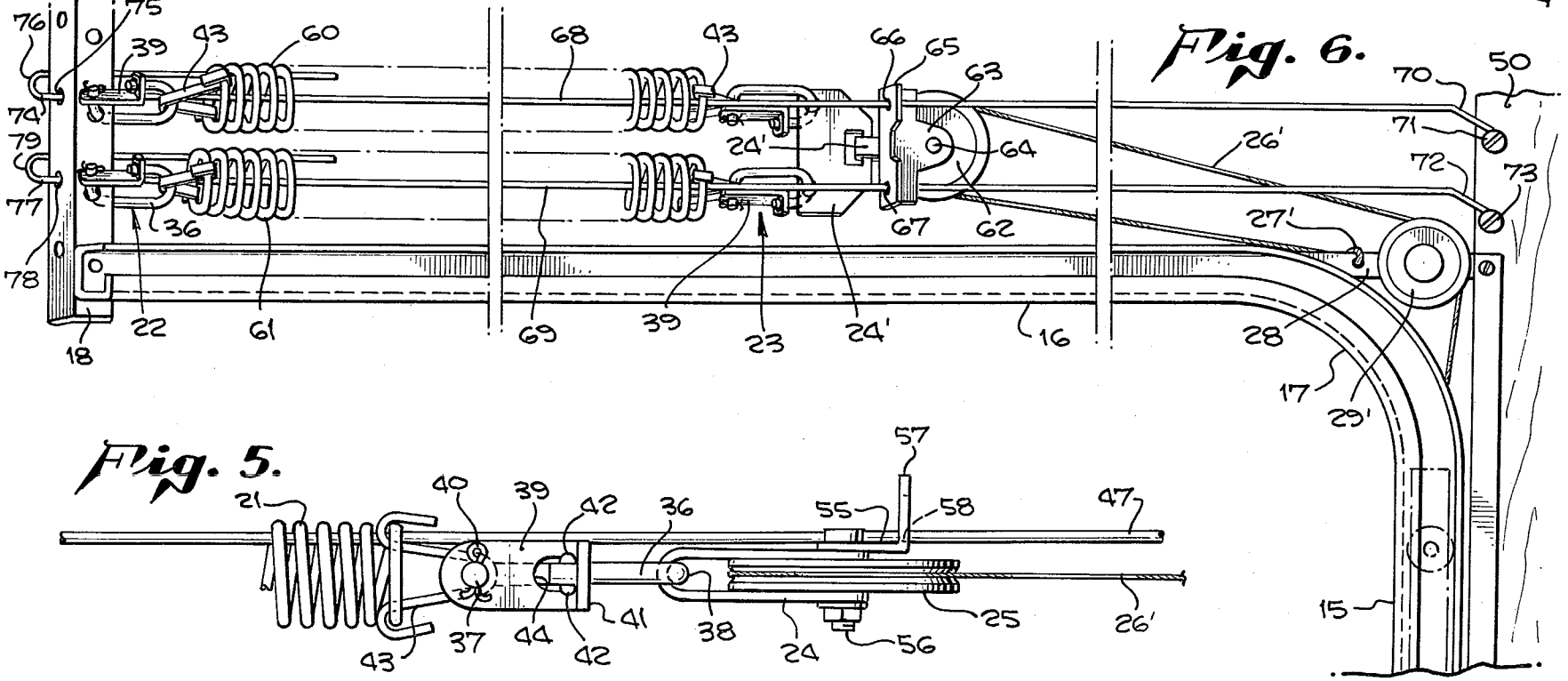
Fig. 6.
Fig. 5.

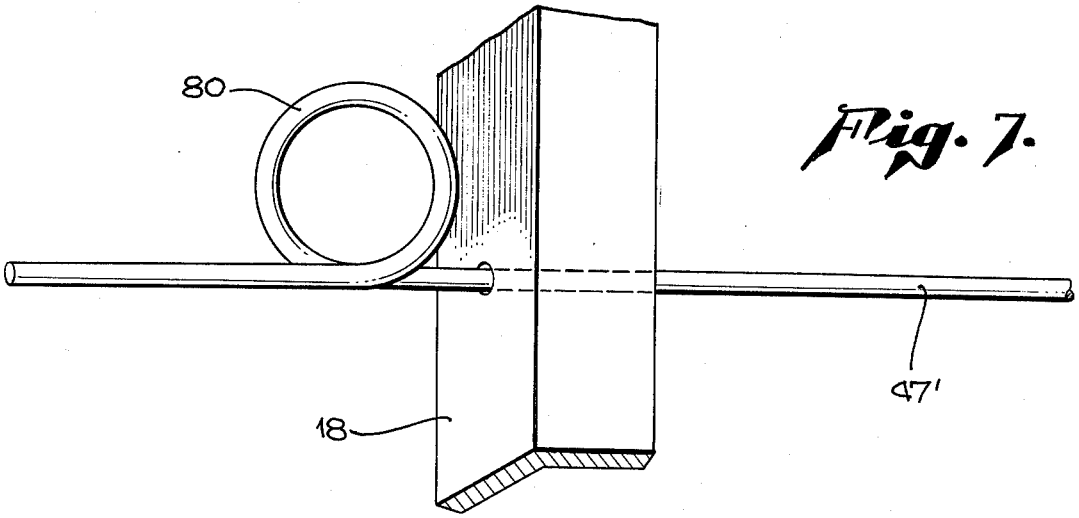
Fig. 7.
Fig. 8.
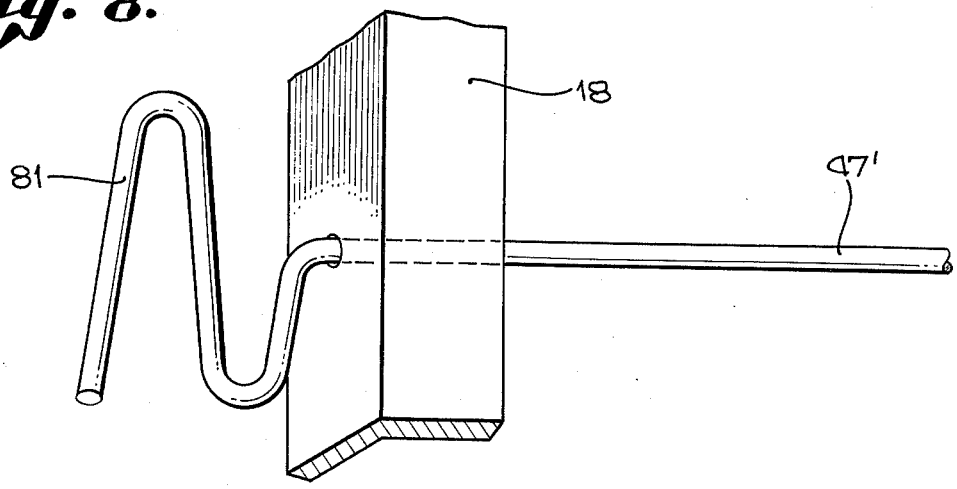
Fig. 9.
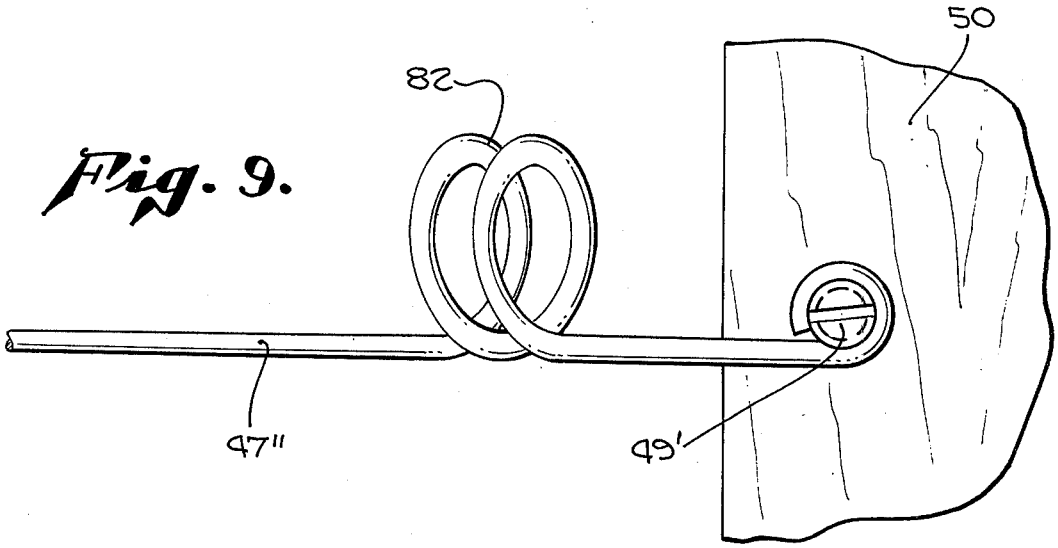

SECTIONAL GARAGE DOOR SPRING CONTAINER

This is a continuation in part of copending application Ser. No. 692,340 filed June 3, 1976 now abandoned.

Counterbalance tension springs which are used to assist in the opening of garage doors require a relatively powerful spring which, when stretched the required amount, possesses a very considerable tension. Then after an appreciable period of use, the spring metal tends to crystallize and fatigue to the point where it will ultimately rupture. Such rupture inevitably occurs when the spring is at virtually full tension; consequently when the tension is released by the rupture, broken pieces of spring are flung about with a considerable force, and the impact of such pieces on either the building structure or articles in the near vicinity is apt to be very damaging.

Conceivably, likelihood of rupture could be diminished perhaps by use of longer springs, or, on occasions, heavier springs. Such expedients are not customarily economically expedient. Springs long enough and heavy enough to virtually lift a two car garage door present an appreciable cost problem which the average customer is not ready to accept. The preferred expedient is to employ relatively lighter springs, sufficient to supply the necessary counterbalance and to make some provision for containment of broken pieces of spring should rupture occur under tension.

When such garage doors are of the sectional type consisting of a relatively large number of horizontally hinged panels, not only are the doors likely to be heavy but the mounting of such doors requires the counterbalance spring to be mounted overhead and in a relatively inaccessible location. Furthermore, the accessory equipment providing for attachment of the counterbalance spring respectively to the door and some stationary structure adds to the problem of providing a containment which will not interfere with the continued dependable operation of the counterbalance spring assembly. Containment expedients heretofore suggested, which may consist of cables or telescoping rods, present operational problems in overhead mounted springs which interfere with the smooth functioning of the accessory attachments.

Precautionary safety code sections have recently been made applicable to provide greater safety in devices of this kind, sufficient to virtually preclude physical injury to people as well as to prevent structural damage. Such code requirements have made some containment expedients heretofore in use, which have been only more or less successful, to be outlawed.

It is therefore among the objects of the invention to provide a new and improved spring containment for counterbalance tension springs especially adapted for use with sectional garage doors which provides dependable containment for ruptures of all kinds in springs of the kind under consideration and also a containment which is reasonably priced.

Another object of the invention is to provide a new and improved counterbalance spring containment for sectional type garage doors which, in addition to being reliable as a restraint for broken spring pieces, also permits smooth, dependable operation of the attachment accessory parts throughout the full range of movement of the sectional garage door.

Still another object of the invention is to provide a new and improved spring containment for sectional type garage doors which is applicable to counterbalance springs of the type currently in use and at customary locations heretofore found almost universally acceptable.

Still another object of the invention is to provide a new and improved counterbalance spring and containment assembly for sectional type garage doors which is secure and dependable, and which is made up of a relatively minimum number of parts whereby to keep the cost to the user within a reasonable range.

Still further among the objects of the invention is to provide a new and improved spring containment for counterbalance springs used on sectional type garage doors which has a cushioning effect when demand for containment is impressed upon it by a broken spring, such that the containment elements themselves do not fracture when called upon to restrain the force of a heavy spring which ruptures under high tension.

With these and other objects in view, the invention consists in the construction, arrangement and combination of the various parts of the device, whereby the objects contemplated are attained, as hereinafter set forth, pointed out in the appended claims, and illustrated in the accompanying drawings.

In the drawings:

FIG. 4 is an enlarged plan view showing the spring in contracted position.

FIG. 5 is a fragmentary side elevational view on line 5—5 of FIG. 4.

FIG. 6 is a side elevational view of a tandem spring assembly.

FIGS. 7, 8 and 9 are side elevational views of modified forms of the rod bent into configurations serving as a cushion.

Figure 2:
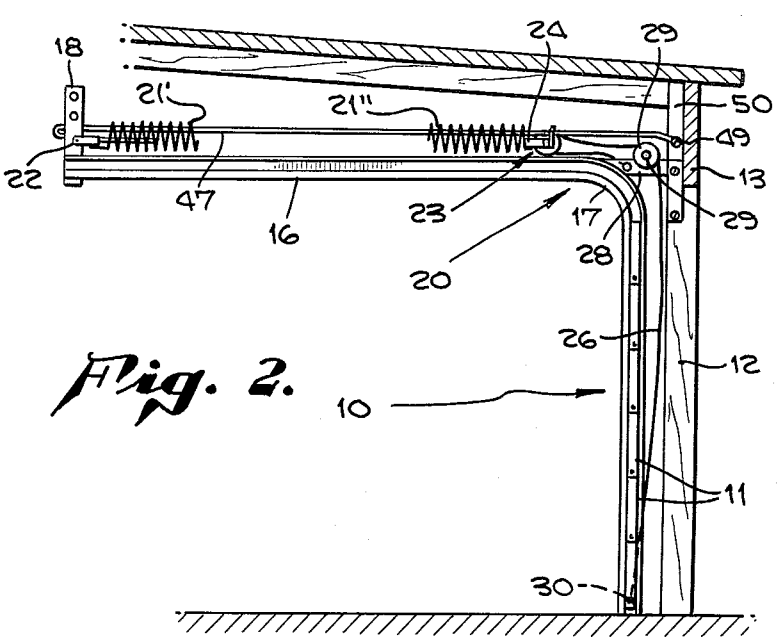
FIG. 2 is a view similar to FIG. 1 showing the spring in broken condition.

In an embodiment of the invention chosen for the purpose of illustration there is shown a sectional garage door indicated generally by the reference character 10 consisting of hinged sections 11 in horizontal relationship, the door being shown in closed position. The structure in which the door is mounted is shown as consisting of doorjambs indicated by the jamb 12 which is part of a frame structure 13 supporting a garage roof 14.

Figure 1:
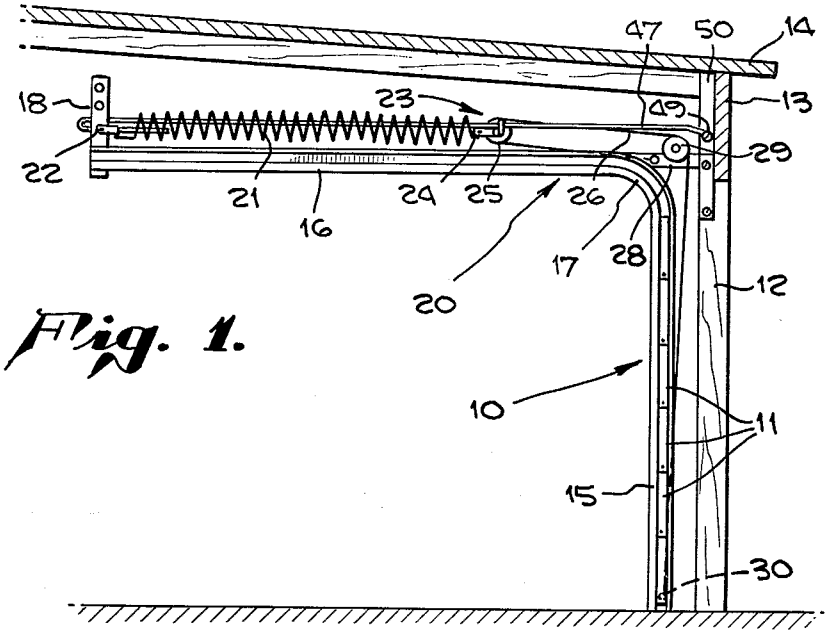
FIG. 1 is a side elevational view of a sectional garage door assembly in place on a building structure with the counterbalance spring stretched in extended position.
Figure 3:
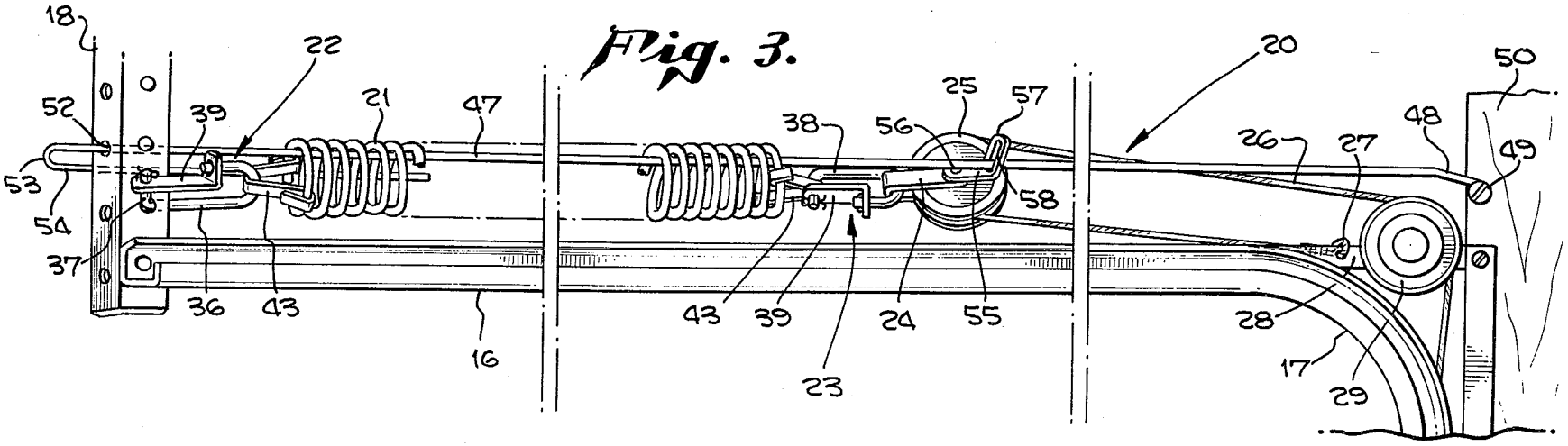
FIG. 3 is an enlarged side elevational view showing the spring in contracted position.

For guiding the door a track is provided, and in FIGS. 1 and 2 the track is represented by a vertical section 15, and an overhead horizontal section 16 joined by a curved section 17. A bracket 18 forming part of the frame structure supports the rear end of the overhead horizontal section 16. There is a track on each side of the doorway formed in part by the jamb 12, the opposite side not being shown.

To counterbalance the weight of the door and make it easier for opening by hand, there is provided a counterbalance spring assembly indicated generally by the reference character 20. More particularly, the counterbalance spring assembly consists of a coiled spring 21, a rear end of which is attached to the bracket 18 by an appropriate connector 22. There is a similar connector 23 at the forward end of the spring 21, the forward connector 23 being attached to a yoke 24 of a pulley 25.

In order to connect the forward end of the coiled spring 21 to the door 10, use is made of a cable 26. One end 27 of the cable is anchored to a bracket 28 which is part of the frame structure. The cable extends around the pulley 25 and then passes forwardly around another pulley 29, which in turn is rotatably mounted on the bracket 28. The other end 30 of the cable is secured to the door 10 at or near the bottom, as shown in FIGS. 1 and 2.

The connectors 22 and 23 are identical and constructed to provide a releasable connection for the respective end of the spring. Each connector consists of a bar bent to form a stringer 36, at one end of which is a transverse leg 37 and at the other end of which is a hook 38. A retentin clip 39 fits over the leg 37 where it is retained by a conventional cotter pin 40. At the other end the retention clip has an arm 41 extending over the free end of the hook 38 on which it is retained by lugs 42. The hook 38 engages a spring keeper 43 which is the means by which the respective end of the spring 21 is attached to the connector.

The leg 37 extends through a hole 44 of the bracket 18, and in this way attached to the frame structure. At the opposite end the hook 38 engages the yoke 24 for the pulley 25.

For the containment of the pieces of spring in event of rupture, there is provided a rod 47 which extends longitudinally through the coils of the spring 21. At its forward end 48 the rod is attached to the frame structure element 50 by means of a bolt 49. The rearward end 51 of the rod protrudes through a hole 52 in the bracket 18 and then is bent loosely around the bracket 18 forming a loop 53 and an end leg 54.

When a heavy spring like the spring 21 breaks under tension there is often a heavy impact on the rod. To prevent rupture of the rod also under such impact the rod itself may be formed to provide a cushion. In the form of invention of FIG. 1, for example, the protruding portion of the rod 52 adjacent the loop 53 together with the end leg 54 serves as a cushion to absorb the impact caused by the spring 21 breaking under tension.

The pulley 25 is actually slidably mounted on the rod 47 by means of a carrier 55. The carrier is attached at one point to the axle 56 of the pulley 25. A bent section 57 of the carrier has a relatively long hole 58 extending through it. The hole 58 is accommodated to the rod 47 so that it can freely slide along the rod as it moves with the position of the door from retracted position to extended position. In the manner described the counterbalance spring assembly is amply supported by the rod 47 in that not only does the rod support the entire length and weight of the spring 21 but also serves as a sliding guide and support for the pulley and attachments to it.

On those occasions where springs are mounted in tandem, as shown in FIG. 6, there are provided two coiled springs 60 and 61, similar to the coiled spring 21, though customarily individually somewhat lighter in weight but providing in tandem an equal or greater counterbalance spring effect. The springs 60 and 61 are provided at opposite ends with the same connectors 22 and 23 as has been described in connection with the single spring assembly. A pulley 62 is mounted somewhat differently in that a yoke 63 to which the pulley is pivotally attached by means of a shaft 64 has a tab 65 with two holes 66 and 67, one slidably receiving rod 68 and the other slidably receiving rod 69. Yoke 24′ is attached to a tandem yoke 24″ with which the connectors 23 are engaged.

The rod 68 has its forward end 70 attached by means of a bolt 71 to the structure element 50. Similarly, the rod 69 has its forward end 72 attached by means of a bolt 73 to the structure element 50. At the rear end 74 of the rod 68 the rod extends through a hole 75 in the bracket 18, and a loop 76 of the rod extends through a hole 78, and the loop 79 attaches the rod to the bracket 18.

In a manner similar to that already described in connection with the single spring assembly a cable 26′ has an end 27′ anchored to the bracket 28. The cable extends around the pulley 62 and around a second pulley 29′ which is rotatably mounted on the bracket 28. The opposite end (not shown) of the cable 26′ attaches to the bottom of the door in the same manner as previously discussed.

Having reference to the single spring assembly, it will be clear that when the door 10 is pulled to a lowered position like that shown in FIGS. 1 and 2, the cable 26 pulls the pulley 25 forwardly, the carrier 55 sliding along the rod 47 to a point near the forward end. At the same time the coils of the coiled spring 21 are stretched to the extended position of FIG. 1. Should the spring rupture in that condition, making two relatively loose pieces 21′ and 21″, the loose pieces are held in place by the rod 47 and prevented from being flung out into space where damage might result. Should a third piece be detached entirely by rupture of the spring in two places, such third piece would still be retained and prevented from being flung into the surrounding premises by the retention action of the rod 47.

The springs 60 and 61 are retained in the same manner by action of the respective rods 68 and 69 in the event of rupture.

Although some auxiliary shock absorbing material in the form of a washer, for example, acting between the rod and the bracket might be relied upon to absorb the initial shock of a broken spring, it is simpler and more economical to rely on the rod itself, in some special configuration. Fig. 7 shows a configuration in the form of a simple 360° loop 80 of a rod 47′ initially bearing against the bracket 18. The comparable configuration 81 of FIG. 8 is a multiple reversely bent end which also serves as a cushion. In FIG. 9 are shown coils 82 at the opposite end of the rod 47″ where it is attached by a bolt 49′ to the door jamb 12 which serve as a cushion.

Having described the invention, what is claimed as new in support of Letters Patent is as follows:

1. In a sectional garage door assembly for a building structure comprising a door opening supporting a vertical track section on each side of the opening and a horizontal overhead section of each track section extending between a front end at said vertical track section to a rear end, a door with opposite side edges slidably mounted in the respective track sections for movement between a vertical closed position and a horizontal open position, and a counterbalance spring assembly for said door comprising a coil spring mounted for action in tension and parallel to and adjacent said horizontal overhead section, said spring having a rear hook up at the rear end to the structure, a movable pulley, and a forward hook up between said pulley and the forward end of the spring, a second stationary pulley mounted on the structure adjacent said vertical track section, and a cable extending over said pulleys and having one end anchored to said structure and the other end attached to the door, the combination of a spring containment device comprising a single length of rod extending through the spring and having a forward attachment at a forward end directly to the structure adjacent said vertical track section and a rearward attachment at the rearward end directly to the structure adjacent the rear hook up, said rod having a length in excess of the distance between the mounting of the stationary pulley on the structure and the rear hook up for said spring to the structure whereby foreward and rear portions of the rod protrude outward beyond the respective end of the spring, a carrier for said movable pulley having a portion in interlocked sliding engagement with said rod, said rear hook up comprising a releasable interlocked connection between the spring and the structure, said forward hook up comprising a releasable interlocked connection between the spring and the carrier and cushioning means for absorbing shock from a ruptured spring comprising a part of one of said portions of the rod adjacent the structure at one of the ends of the rod said part having the form of a loop extending laterally relative to that part of the rod which lies within the spring, whereby material of the rod comprises the cushioning means to absorb the shock.

2. In a sectional garage door assembly as in claim 1, said forward hook up including a bracket having a laterally angular offset portion with a hole therethrough for the rod and adapted to support said carrier below and spaced from the rod.

3. In a sectional garage door assembly as in claim 1, said carrier comprising a U-shaped section attached to said forward hook up, a bracket having a hole therethrough for said rod, and a pulley shaft extending through legs of said U-shaped section and through said bracket whereby to enable angular adjustment therebetween.

4. In a sectional garage door assembly as in claim 1, there being two of said springs in parallel relationship, a separate rod through each spring with said carrier having portions in interlocked sliding engagement with both of said legs, the rod of each of said springs having part thereof in the form of a loop.

5. A counterbalance spring assembly as in claim 1, wherein the loop comprises part of the attachment of one end of the rod to the structure and said one end of the rod adjacent the loop is substantially free and capable of movement relative to the structure.

* * * * *